US007053840B2

(12) United States Patent
Hilgers

(10) Patent No.: US 7,053,840 B2
(45) Date of Patent: May 30, 2006

(54) MICROWAVE ANTENNA

(75) Inventor: Achim Hilgers, Alsdorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/506,284

(22) PCT Filed: Feb. 28, 2003

(86) PCT No.: PCT/IB03/00768

§ 371 (c)(1),
(2), (4) Date: Aug. 31, 2004

(87) PCT Pub. No.: WO03/075401

PCT Pub. Date: Sep. 12, 2003

(65) Prior Publication Data

US 2005/0128145 A1 Jun. 16, 2005

(30) Foreign Application Priority Data

Mar. 6, 2002 (DE) ..... 102 09 961

(51) Int. Cl.
*H01Q 1/24* (2006.01)

(52) U.S. Cl. ..... 343/702; 343/700 MS; 343/895

(58) Field of Classification Search ..... 343/700 MS, 343/702, 895; H01Q 1/24
See application file for complete search history.

(56) References Cited

U.S. PATENT DOCUMENTS 5,867,126 A * 2/1999 Kawahata et al. ..... 343/702
5,909,198 A * 6/1999 Mandai et al. ..... 343/895
6,111,545 A * 8/2000 Saari ..... 343/702
6,633,261 B1 * 10/2003 Iwai et al. ..... 343/700 MS

* cited by examiner

*Primary Examiner*—Hoanganh Le

(57) ABSTRACT

A microwave antenna is described, having a substrate (11), at least one resonant metallization structure (1) and at least a first and a second feed point (3, 4, 6, 7) for coupling in HF power to be radiated, said antenna being particularly suitable for surface mounting on a printed circuit board (20). The feed points (3, 4, 6, 7) are so arranged in this case that, for different positions of the antenna (10) on a printed circuit board (20), it is in each case possible to select a feed point in which case the electrical properties of the antenna (10) are at least substantially unchanged.

17 Claims, 3 Drawing Sheets

MICROWAVE ANTENNA

This application is a 371 of PCT/IB03/00768 filed on Feb. 28, 2003 and claims priority benefits of Germany Patent Application No. 102 09 961.8 filed Mar. 06, 2002.

The invention relates to a microwave antenna having a substrate and at least one resonant metallization structure, particularly for surface mounting on a printed circuit board (PCB). The invention also relates to a printed circuit board of this kind and to a mobile telecommunications device having such a microwave antenna.

In mobile telecommunications, electromagnetic waves in the microwave range are used for transmitting information. Examples of this are the GSM mobile telephone standards in the frequency ranges from 890 to 960 MHz (GSM900), from 1710 to 1880 MHz (GSM1800 or DCS) and from 1850 to 1990 MHz (GSM1900 or PCS), and also the UMTS band (1885 to 2200 MHz), the DECT standard for cordless telephones in the frequency range from 1880 to 1900 MHz, and the Bluetooth standard in the frequency range from 2400 to 2480 MHz, the purpose of which latter is to allow data to be exchanged between for example mobile telephones and other electronic devices such as computers, other mobile telephones, and so on.

The antennas in this case radiate electromagnetic energy by setting up an electromagnetic resonance. This requires the length of the antenna to be at least equal to a fourth of the wavelength of the radiation emitted. With air as a dielectric ($\in_r=1$), the length of antenna needed for a frequency of 1000 MHz is therefore 75 mm.

To minimize the size of the antenna at a given wavelength for the emitted radiation, a dielectric having a dielectric constant $\in_r>1$ can be used as the basic building block for the antenna. This causes the wavelength of the radiation to be shortened in the dielectric by a factor of $$\frac{1}{\sqrt{\varepsilon_r}}.$$

The size of an antenna designed on the basis of a dielectric of this kind will therefore become smaller by this same factor.

An antenna of this kind comprises a block (substrate) of dielectric material. One or more resonant metallization structures are applied to the surfaces of this substrate as dictated by the desired frequency band or bands. The values of the resonant frequencies depend on the dimensions of the printed metallization structure and on the value of the dielectric constant of the substrate. The values of the individual resonant frequencies become lower as the length of the metallization structures increases and as the values of the dielectric constant become higher. Antennas of this kind are also referred to as printed wire antennas (PWA) or dielectric block antennas (DBA) and are disclosed in for example DE 100 49 844.2 and DE 100 49 845.0.

A particular advantage of such antennas is that they, together with other components where required, can be fitted directly to a printed circuit board (PCB) by surface mounting (SMD), i.e. by being soldered flat to the board and by contacts being made in the same way, without any additional mountings (pins) being required to feed in the electromagnetic power.

However, what is disadvantageous about these antennas is that their electrical properties are affected by the properties of their surroundings, such as by for example the nature of a surrounding plastic housing and by how far the latter is away from the antenna, and they are also dependent on the location at which the antennas are soldered to the PCB. If for example the antenna is sized for mounting at the righthand top corner of the PCB, mounting it anywhere else causes major changes in its input characteristics, such as a shift in the center frequency, which in turn leads to a change in its radiating characteristics.

It is therefore an object of the invention to provide a microwave antenna whose electrical properties are at least largely independent of the point, and in particular the corner, at which it is mounted on a printed circuit board.

The intention is also to provide a microwave antenna whose electrical properties are at least largely independent of the nature and distance away of a surrounding housing.

The intention is further to provide a microwave antenna of this kind that is also suitable for use as a dual-band or multiband antenna for the frequency ranges for mobile telecommunications that were mentioned in the opening paragraphs.

Finally, the intention is also to provide a microwave antenna of this kind whose manufacturing costs are considerably lower than those of comparable known microwave antennas.

The object is achieved, as detailed in claim 1, by a microwave antenna having a substrate, at least one resonant metallization structure and at least a first and a second feed point for coupling in HF power to be radiated, the feed points being so arranged that, for different positions of the antenna on a printed circuit board, it is in each case possible to select a feed point in which case the electrical properties of the antenna are at least substantially unchanged.

A particular advantage of this way of achieving the object is that it can be applied to antennas for all the frequency ranges mentioned in the opening paragraphs and also to dual-band and multiband antennas.

The dependent claims relate to advantageous further embodiments of the invention.

With the further embodiments detailed in claims 2, 3 and 4, it is, to a particularly large degree, possible for the electrical properties of the antenna to remain unchanged if there is a change in its position.

The advantage of the further embodiment detailed in claim 5 is that the antenna can be tuned in respect of its resonant frequencies even in the fitted state. This is particularly true of the further embodiment in claim 7 if, in it, the metallization structure is resting on the PCB concerned and is thus no longer accessible once the antenna has been mounted.

The further embodiment detailed in claim 7 has the advantage that considerable cost savings are obtained in manufacture because the substrate has to be printed (or etched) on only one side to give it the metallization structure. A further cost saving is achieved if the antenna is mounted on the PCB in such a way that the main face of the substrate that carries the metallization structure rests on the PCB, because when this is the case no feed pins but only soldering points are required to make contact with the metallization structure.

Finally, it is possible with the further embodiments detailed in claims 6 and 8 to achieve particularly good antenna properties in the frequency ranges mentioned in the opening paragraphs with respect to the definition of the resonant frequencies.

These and other aspects of the invention are apparent from and will be elucidated with reference to the embodiments described hereinafter.

IN THE DRAWINGS

Figure 1:
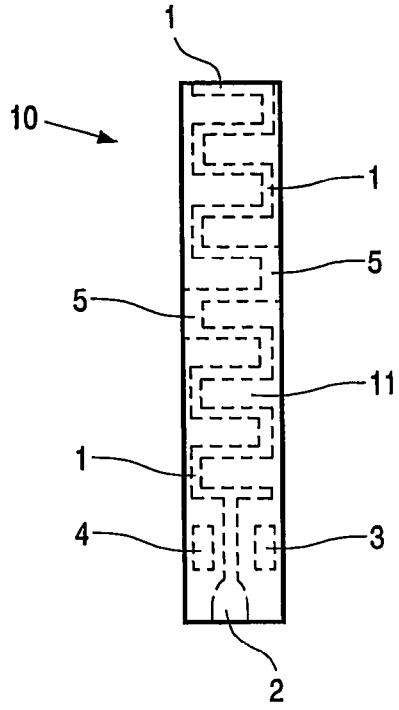
FIG. 1 is a diagrammatic plan view of a first embodiment of the antenna.

As far as their basic type is concerned, the antennas 10 described are so-called printed wire antennas (PWA) or dielectric block antennas (DBA), in which at least one resonant metallization structure 1 is applied to a substrate 11. Hence the antennas in question are, in principle, wire antennas which, unlike microstrip line antennas, do not have an area of metal on the back of the substrate 11 to form a reference potential.

The embodiments described below have a substrate 11 in the form of a block of substantially parallelepiped shape whose height is smaller than its length or width by a factor from 3 to 10. On this basis, the (large) face of the substrate 11 that is the upper face in the views shown in FIGS. 1 and 4 will be referred to in the description that follows as the upper main face, the face that rests on a printed circuit board 20 will be referred to as the lower main face and the faces that are oriented perpendicularly thereto will be referred to as the side faces.

It is however also possible for other geometric shapes to be selected for the substrate rather than a right parallelepiped one, such as for example a cylindrical one, to which a corresponding resonant metallization structure following for example a spiral path would be applied.

The substrates can be manufactured by embedding a ceramic powder in a polymer matrix and they have a dielectric constant of $\in_r>1$ and/or a relative permeability of $\mu_r>1$.

To be exact, the first embodiment of the antenna 10 shown in FIG. 1 comprises a parallelepiped-shaped dielectric substrate 11 having a length of approximately 10.5 mm, a width of approximately 2.4 mm and a height of 1 mm. The substrate material has a dielectric constant $\in_r$ of approximately 21.5.

Applied to the lower main face of the substrate 11 is a first resonant metallization structure 1 (indicated in broken lines), which is connected to a ground potential via a first connecting point (soldering point) 2. The metallization structure 1 can be formed by one or more individual metallizations in the form of printed conductors and these may even be of different widths if required. In the first embodiment shown it extends for the entire length of the substrate in a substantially meander-shaped configuration and has an electrically effective length L' of $$\frac{L}{\sqrt{\varepsilon_r}},$$

where L is the wavelength of the signal in free space. The size of the metallization structure is such that its length is equal to approximately half the wavelength at which the antenna is intended to radiate electromagnetic power. If for example the antenna is to operate to the Bluetooth standard, which operates in a frequency range between 2400 and 2483.5 MHz, this gives a wavelength L of approximately 12.5 cm in free space. Given a dielectric constant $\in_r$ for the substrate of 21.5, half the wavelength 0.5 L', and hence the geometrical length required for the metallization structure 1, shortens to approximately 13.48 mm.

The resonant metallization structure 1 could also be embedded in the substrate 11.

On the lower main face of the substrate 11 there are, in addition to the resonant metallization structure 1, at least two further metallization structures that are used as feed points 3, 4 for the capacitive infeed of the HF power to be radiated.

As shown in FIG. 1, these points are a first feed point 3 and a second feed point 4, which are arranged, in the region of the first connecting point 2, at opposite edges of the lower main face of the substrate 11 symmetrically to the longitudinal axis of the substrate 11. For production-related reasons, the feed points 3, 4 are preferably spaced approximately 200 μm away from the edge of the substrate 11. Like the first connecting point 2, the feed points 3, 4 are soldered to corresponding contact points in a printed circuit board 20.

Since there are thus three soldering points (2, 3, 4) in the region of one lengthwise end of the substrate 11, further soldering points 5 are provided to improve mechanical load-bearing capacity in case the PCB 20 is for example bent and to ensure reliable contact, the soldering points 5 being arranged on the lower main face, for mechanical reasons, in the region of the opposite lengthwise end of the substrate 11.

Figure 2:
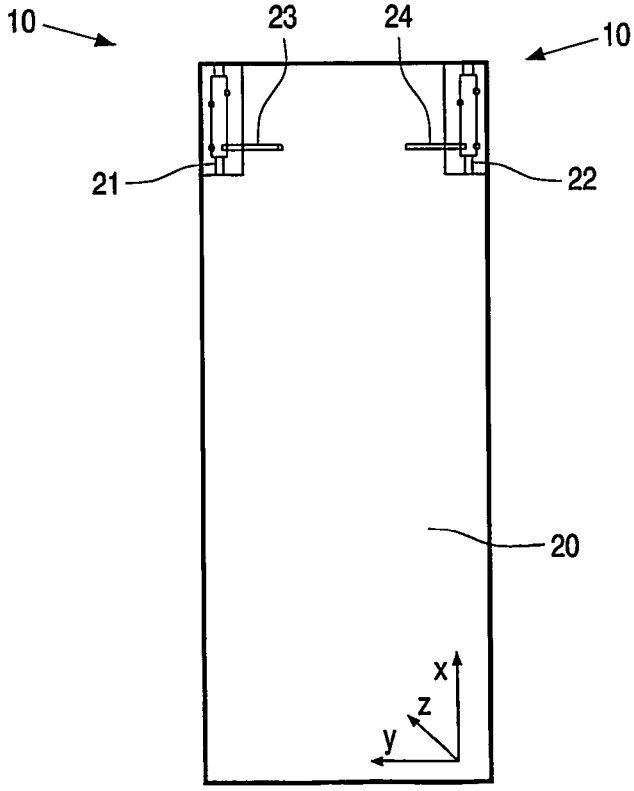
FIG. 2 is a diagrammatic view of a printed circuit board having an antenna according to the invention at different points.

FIG. 2 is a diagrammatic view of a PCB 20 that is of the dimensions typical for a mobile telecommunications device of, for example, 90×35 mm. An antenna 10 is usually fastened to one of the four corners of a PCB 20 of this kind. In FIG. 2 an antenna 10 is shown in each of the top right and left corners, to show two of the possible fitted positions.

It can also be seen from FIG. 2 that the first connecting point 2 to the resonant metallization structure 1 is soldered to first printed conductors 21 and 22 respectively (ground connections). The capacitive infeed of the HF power to be radiated takes place via second and third printed conductors 23 and 24 respectively. What is crucial to ensure that the electrical properties of the antenna 10 are not affected by its positioning at one of the corners of the board 20, is that the feed point 3, 4 that is suitable in the particular case is selected for this infeed.

As can be seen from FIG. 2, the first feed point 3 is selected if the antenna 10 is positioned in the top left corner and is soldered to the first printed conductor 23, whereas if the antenna 10 is positioned in the top right corner it is the second feed point 4 that is connected to the second printed conductor 24. Whichever feed point 4, 3 is not used in the given case remains unconnected and is thus at a floating potential.

Where the antenna 10 is positioned at the bottom left or right corner in FIG. 2, the same applies but with mirror symmetry.

Figure 3:
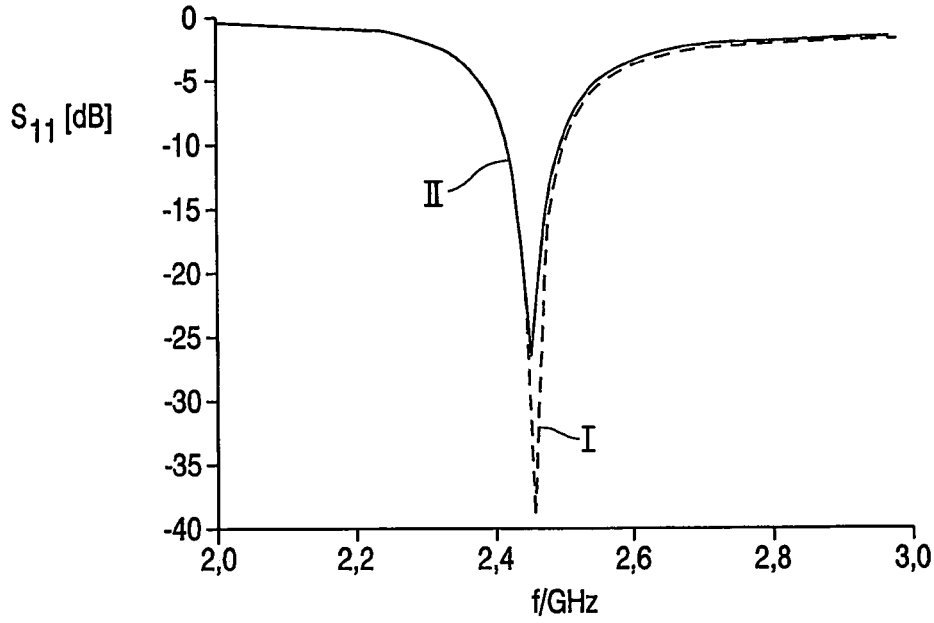
FIG. 3 shows the curve for the $S_{11}$ parameters of the first embodiment of antenna.

Measurements of the $S_{11}$ parameters were made for the two positions of the antenna 10 shown in FIG. 2 and were compared with one another. The results of these measurements are shown in FIG. 3. The broken line I is the curve for the $S_{11}$ parameters of the antenna 10 when in the top left corner of the PCB whereas positioning the antenna 10 in the top right corner produced the $S_{11}$ parameters represented by the solid line II. The difference of approximately 2 MHz that can be seen in FIG. 2 between the two resonant frequencies was caused by the fact that the two positions could not be exactly duplicated.

To produce a dual-band or multiband antenna, two or more resonant metallization structures 1 may be applied to the substrate 11 or embedded therein.

Surprisingly, it has also been found that, to obtained the desired electrical properties for the antenna 10, it is enough for the complete metallization structure 1 to be applied to only one of the main faces of the substrate 11, particularly when it is of the meander configuration shown (of or some other suitable configuration). If the feed and connecting points 3, 4, 2 are also situated on this main face, this gives the crucial advantage that the manufacturing costs of the antenna can be substantially reduced because the substrate 11 no longer has to be printed in three dimensions to apply the metallization structures 1, which are usually distributed over more than one face.

Figure 4:
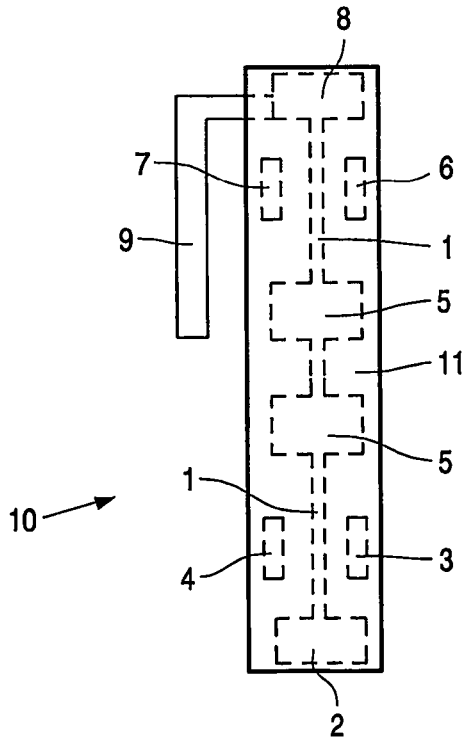
FIG. 4 is a diagrammatic plan view of a second embodiment of the antenna.

If in addition the antenna 10 is mounted on the PCB 20 in such a way that the main face carrying the metallization structures 1, 2, 3, 4 is the lower main face, then there is also no need for any feed pins (but only soldering points) for making contact with the metallization structures FIG. 4 shows a second embodiment of the antenna 10 according to the invention, parts that are identical or that correspond to one another being identified by the same reference numerals as in FIG. 1.

This antenna 10 too comprises a substrate 11, and a resonant metallization structure 1 is applied to that main face of the substrate 11 which is the lower face in the view shown. This metallization structure 1 is once again connected to a ground potential of a PCB (not shown) via a first connecting point 2 and is fed capacitively by means of feed points. As well as a first and a second feed point 3, 4 which correspond to those of the first embodiment shown in FIG. 1, an additional third and fourth feed point 6, 7 are provided in this second embodiment, these additional points 6, 7 being arranged symmetrically to the first and second feed points 3, 4 respectively about the transverse axis of the substrate.

This antenna 10 also has a second connecting point 8 that is arranged at the opposite end of the metallization structure 1 from the first connecting point 2 and is connected to a printed conductor 9 on the PCB (not shown).

This printed conductor 9 is a tuning stub by which the resonant frequency of the metallization structure 1 can be tuned with the antenna 10 in the fitted state, by for example reducing its length with a laser beam. The antenna 10 is thus tunable in the fitted state, even though the metallization structure 1 on the lower main face of the substrate 11 is no longer accessible in this state.

Figure 5:
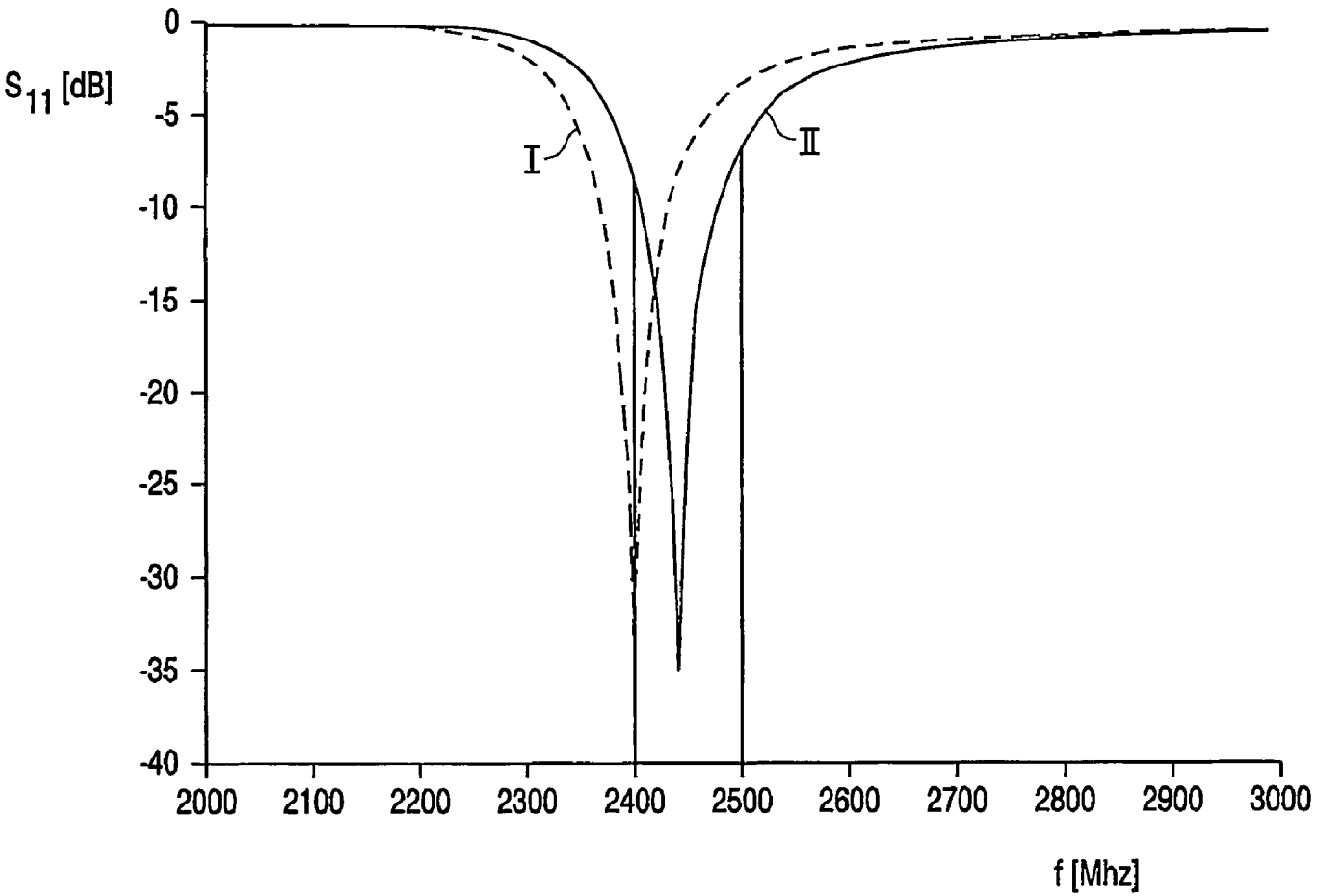
FIG. 5 shows the curve for the $S_{11}$ parameters of the second embodiment of antenna.

FIG. 5 shows the input characteristics of the antenna 10 in the form of its $S_{11}$ parameters for two different lengths of the printed conductor 9. The broken line I shows the curve for the $S_{11}$ parameters when the printed conductor 9 was approximately 3 mm long, whereas the solid line II shows the curve after the conductor 9 had been shortened to a length of approximately 2 mm. It can clearly be seen from the curves that when this was done the resonant frequency of the antenna 10 shifted from approximately 2.4 GHz to approximately 2.45 GHz.

This embodiment also has the advantage that, due to the symmetrical arrangement of four feed points 3, 4, 6, 7, the antenna 10 can, if required, also be mounted on a PCB 20 in a position rotated through 180° degree in the plane of the drawing. In volume production for example, this makes it unnecessary for a visual check to be made to see that the antenna 10 is correctly positioned on the PCB 20, thus allowing time and money to be saved.

With regard to the positioning of the antenna 10, the same also applies as was said in relation to the first embodiment, as also does the description relating to FIG. 2. In this embodiment too the unused feed points are left unconnected.

Finally, this embodiment has an alternative metallization structure 1 that extends for the length of the substrate 11, approximately in the center of the (lower) main face, in a substantially straight line. Provided along the length of the metallization structure 1 are two soldering points 5 that are once again used to provide additional mechanical fixing for the antenna 10 to the PCB 20.

The antennas 10 according to the invention are thus suitable for use on printed circuit boards of different layouts with no change to their dimensions, their metallization structures or their connections. Particularly where there are a plurality of resonant metallization structures for different frequency bands of the kind mentioned in the opening paragraphs, this thus gives a capacity for universal use in different devices for mobile telecommunications.

Finally, it should also be pointed out that in the case of a dual-band or multiband antenna having a plurality of metallization structures 1, a printed conductor 9 used for tuning the resonant frequency of a metallization structure 1 may be provided on the PCB 20 for each such metallization structure 1.

It is of course possible even for a substrate antenna that is not provided with the symmetrically arranged feed points 3, 4, 6, 7 described, or whose metallization structure(s) extend over a plurality of faces of the substrate 11, to be connected to a printed conductor 9 that is arranged on the PCB 20 concerned and can be used to tune the resonant frequency of the relevant metallization structure 1 by changing the length of the conductor 9. Tunability by means of a printed conductor 9 of this kind is thus not confined to antennas of this kind that have symmetrical feed points or whose metallization structure extends over only one main face.

The invention claimed is:

1. A microwave antenna having a substrate, at least one resonant metallization structure and at least a first and a second feed point for coupling in HF power to be radiated, the feed points being so arranged that, for different positions of the antenna on a printed circuit board, it is in each case possible to select a feed point in which case the electrical properties of the antenna are at least substantially unchanged.

2. The microwave antenna of claim 1, wherein the feed points are arranged in the region of the edge of a main surface of the substrate symmetrically to a longitudinal and/or transverse axis of the substrate.

3. The microwave antenna of claim 1, wherein the HF power to be radiated is capacitively coupled into the at least one metallization structure via the feed points.

4. The microwave antenna of claim 1, further comprising a first connecting point, wherein the at least one metallization structure is connected to a ground potential of the printed circuit board via the first connecting point.

5. The microwave antenna of claim 4, further comprising a second connecting point, wherein the at least one metallization structure is connected, via the second connecting point, to a printed conductor on the printed circuit board whose length can be changed to tune a resonant frequency of the antenna.

6. The microwave antenna of claim 5, wherein the first and second connecting points are situated at opposite ends of the at least one metallization structure.

7. The microwave antenna of claim 6, wherein the at least one metallization structure and the feed and connecting points are situated on one main surface of the substrate.

8. The microwave antenna of claim 1, wherein the at least one metallization structure extends in a substantially meander-shaped configuration.

9. A telecommunications device, comprising:

a housing:

a printed circuit board inside the housing: and a microwave antenna as claimed in claim 1, mounted on the printed circuit board.

10. The telecommunications device of claim 9, wherein the HF power to be radiated is capacitively coupled into the at least one metallization structure via the feed points.

11. The telecommunication device of claim 9, further comprising a first connecting point, wherein the at least one metallization structure is connected to a ground potential of the printed circuit board via the first connecting point.

12. The telecommunication device of claim 11, further comprising a second connecting point, wherein the at least one metallization structure is connected, via the second connecting point, to a printed conductor on the printed circuit board whose length can be changed to tune a resonant frequency of the antenna.

13. The telecommunication device of claim 12, wherein the first and second connecting points are situated at opposite ends of the at least one metallization structure.

14. The telecommunication device of claim 13, wherein the at least one metallization structure and the feed and connecting points are situated on one main surface of the substrate.

15. A microwave antenna, comprising:

a dielectric substrate having a dielectric constant greater than one;

at least one resonant metallization structure disposed on a surface of the dielectric substrate;

a first connection point on the surface of the dielectric substrate for connecting a first end of the resonant metallization structure to a ground potential; and a plurality of feed points disposed on the surface of the dielectric substrate, each of said feed points being adapted to selectively capacitively couple high frequency energy into the resonant metallization structure, wherein the feed points are arranged on the surface of the dielectric substrate such that when the microwave antenna is mounted on a printed circuit board, for each mounting position of the microwave antenna on the printed circuit board it is possible to select and connect one of the feed points to a contact point on the printed circuit board so as to maintain the electrical properties of the antenna to be substantially the same.

16. The microwave antenna of claim 15, further comprising a second connecting point wherein the at least one metallization structure is connected, via the second connecting point to a printed conductor on the printed circuit board whose length can be changed to tune a resonant frequency of the antenna.

17. The microwave antenna of claim 16, wherein the first and second connecting points are situated at opposite ends of the at least one metallization structure.

* * * * *